US005901378A

United States Patent [19]

Kirsch

[11] Patent Number: 5,901,378

[45] Date of Patent: May 11, 1999

[54] GLOVE WITH FINGERNAIL PROTECTORS

[76] Inventor: Clare A. Kirsch, 150 Main St., Linfield, Pa. 19468

[21] Appl. No.: 09/010,749

[22] Filed: Jan. 22, 1998

[51] Int. Cl.[6] ..... A41D 13/10

[52] U.S. Cl. ..... 2/163; 2/168; 2/21

[58] Field of Search ..... 2/163, 159, 21, 2/168, 161.6, 160, 161.7; 223/101

[56] References Cited

U.S. PATENT DOCUMENTS

| | | | |
|---|---|---|---|
| 370,397 | 9/1887 | Kayser | 2/163 |
| 925,207 | 6/1909 | Lindner | 2/163 |
| 1,005,511 | 10/1911 | Carson | 2/163 |
| 1,010,283 | 11/1911 | Loy | 2/163 |
| 1,066,480 | 7/1913 | Finlay | 2/163 |
| 1,486,006 | 3/1924 | Blom | 2/163 |
| 2,736,034 | 2/1956 | Fredenhagen et al. | 2/163 |
| 5,661,853 | 9/1997 | Wilmot | 2/163 |

FOREIGN PATENT DOCUMENTS

| | | | |
|---|---|---|---|
| 120668 | 9/1979 | Japan | 2/163 |
| 111765 | 12/1917 | United Kingdom | 2/163 |

*Primary Examiner*—Amy B. Vanatta

[57] ABSTRACT

A new glove with fingernail protectors for protecting the fingernails of a wearer from accidental breaking or chipping. The inventive device includes a palm portion with a plurality of digit portions extending therefrom. The back of each of the digit portions has a fingernail region extending from the tip of the digit portion towards the root of the digit portion. The thickness of the fingernail region of each of the digit portions is greater than the thickness of the rest of the digit portion to provide protection against chipping and breaking to the fingernails of a wearer.

8 Claims, 3 Drawing Sheets

GLOVE WITH FINGERNAIL PROTECTORS

BACKGROUND OF THE INVENTION

1. Field of the Invention

The present invention relates to gloves and more particularly pertains to a new glove with fingernail protectors for protecting the fingernails of a wearer from accidental breaking or chipping.

2. Description of the Prior Art

The use of gloves is known in the prior art. More specifically, gloves heretofore devised and utilized are known to consist basically of familiar, expected and obvious structural configurations, notwithstanding the myriad of designs encompassed by the crowded prior art which have been developed for the fulfillment of countless objectives and requirements.

Known prior art gloves include U.S. Pat. No. 4,995,119; U.S. Pat. No. 4,858,245; U.S. Pat. No. 5,187,815; U.S. Pat. No. 5,186,189; U.S. Pat. No. Des. 358,245; and U.S. Pat No. 5,140,709.

While these devices fulfill their respective, particular objectives and requirements, the aforementioned patents do not disclose a new glove with fingernail protectors. The inventive device includes a palm portion with a plurality of digit portions extending therefrom. The hack of each of the digit portions has a fingernail region extending from the tip of the digit portion towards the root of the digit portion. The thickness of the fingernail region of each of the digit portions is greater than the thickness of the rest of the digit portion to provide protection against chipping and breaking to the fingernails of a wearer.

In these respects, the glove with fingernail protectors according to the present invention substantially departs from the conventional concepts and designs of the prior art, and in so doing provides an apparatus primarily developed for the purpose of protecting the fingernails of a wearer from accidental breaking or chipping.

SUMMARY OF THE INVENTION

In view of the foregoing disadvantages inherent in the known types of gloves now present in the prior art, the present invention provides a new glove with fingernail protectors construction wherein the same can be utilized for protecting the fingernails of a wearer from accidental breaking or chipping.

The general purpose of the present invention, which will be described subsequently in greater detail, is to provide a new glove with fingernail protectors apparatus and method which has many of the advantages of the gloves mentioned heretofore and many novel features that result in a new glove with fingernail protectors which is not anticipated, rendered obvious, suggested, or even implied by any of the prior art gloves, either alone or in any combination thereof.

To attain this, the present invention generally comprises a palm portion with a plurality of digit portions extending therefrom. The back of each of the digit portions has a fingernail region extending from the tip of the digit portion towards the root of the digit portion. The thickness of the fingernail region of each of the digit portions is greater than the thickness of the rest of the digit portion to provide protection against chipping and breaking to the fingernails of a wearer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new glove with fingernail protectors apparatus and method which has many of the advantages of the gloves mentioned heretofore and many novel features that result in a new glove with fingernail protectors which is not anticipated, rendered obvious, suggested, or even implied by any of the prior art gloves, either alone or in any combination thereof.

It is another object of the present invention to provide a new glove with fingernail protectors which may be easily and efficiently manufactured and marketed.

It is a further object of the present invention to provide a new glove with fingernail protectors which is of a durable and reliable construction.

An even further object of the present invention is to provide a new glove with fingernail protectors which is susceptible of a low cost of manufacture with regard to both materials and labor, and which accordingly is then susceptible of low prices of sale to the consuming public, thereby making such glove with fingernail protectors economically available to the buying public.

Still yet another object of the present invention is to provide a new glove with fingernail protectors which provides in the apparatuses and methods of the prior art some of the advantages thereof, while simultaneously overcoming some of the disadvantages normally associated therewith.

Still another object of the present invention is to provide a new glove with fingernail protectors for protecting the fingernails of a wearer from accidental breaking or chipping.

Yet another object of the present invention is to provide a new glove with fingernail protectors which includes a palm portion with a plurality of digit portions extending therefrom. The back of each of the digit portions has a fingernail region extending from the tip of the digit portion towards the root of the digit portion. The thickness of the fingernail region of each of the digit portions is greater than the thickness of the rest of the digit portion to provide protection against chipping and breaking to the fingernails of a wearer.

Still yet another object of the present invention is to provide a new glove with fingernail protectors that protect a wearer's fingernails while not interfering with the bending of the joints of the fingers.

Even still another object of the present invention is to provide a new glove with fingernail protectors that protect a wearer's fingernails without affecting sensitivity of touch of the fingertips.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
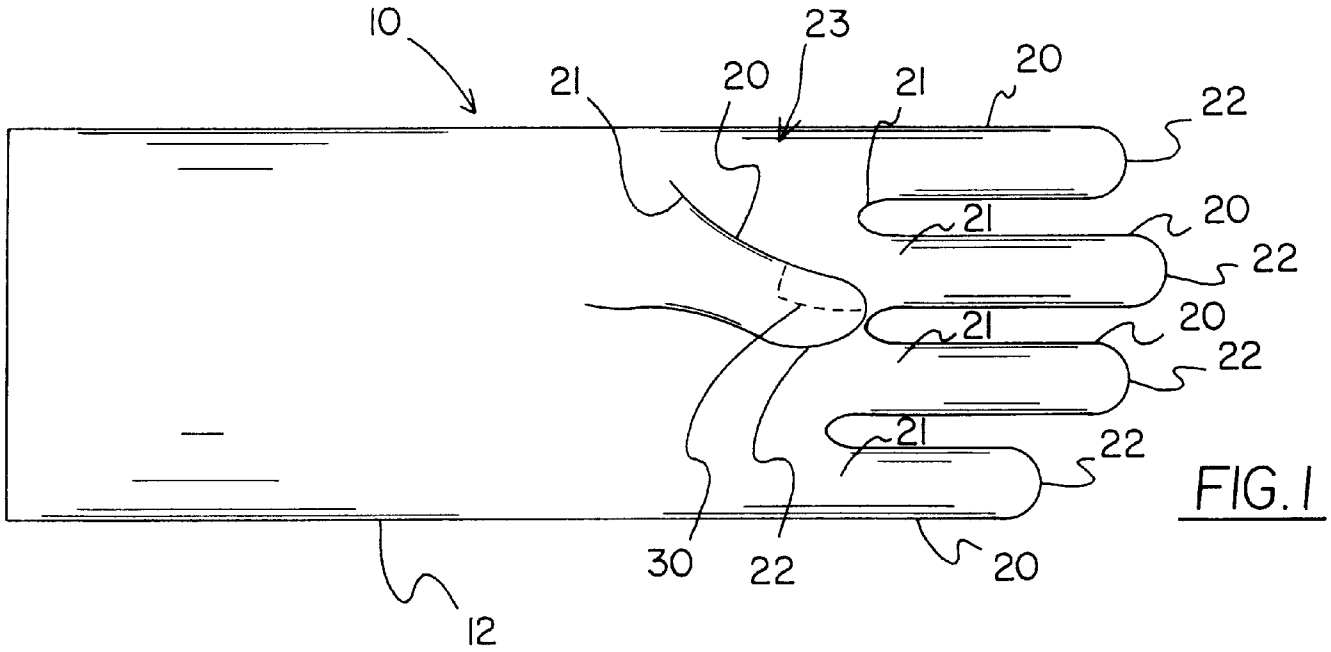
FIG. 1 is a schematic front side view of a new glove with fingernail protectors according to the present invention.
Figure 2:
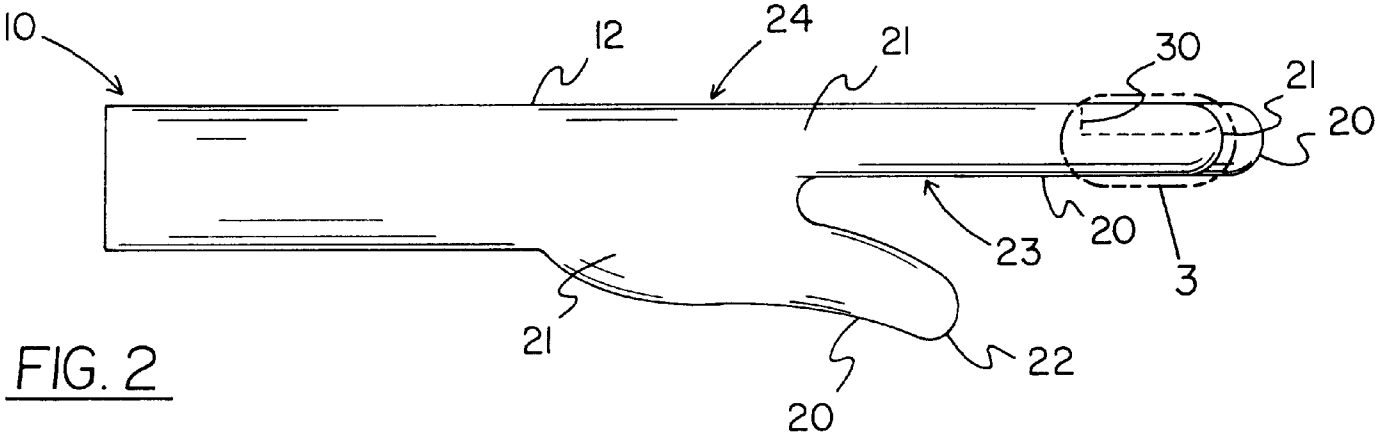
FIG. 2 is a schematic side view of the present invention.

With reference now to the drawings, and in particular to FIGS. 1 through 5 thereof, a new glove with fingernail protectors embodying the principles and concepts of the present invention and generally designated by the reference numeral 10 will be described.

As best illustrated in FIGS. 1 through 5, the glove with fingernail protectors 10 generally comprises a palm portion 12 with a plurality of digit portions 20 extending therefrom. The back 24 of each of the digit portions 20 has a fingernail region 30 extending from the tip 22 of the digit portion 20 towards the root 21 of the digit portion 20. The thickness of the fingernail region 30 of each of the digit portions 20 is greater than the thickness of the rest of the digit portion 20 to provide protection against chipping and breaking to the fingernails of a wearer.

The glove 10 is preferably the of the dishwashing and cleaning sort and ideally having the palm and digit portions 12,20 constructed from rubber, latex, or spandex. As illustrated in FIG. 1, a plurality of digit portions 20 for inserting a finger or thumb therein are extended from the palm portion 12. Each of the digit portions 20 has a root 21 located adjacent the palm portion 12 and terminates at a tip 22. The length of each digit portion is defined extending between its root 21 and the tip 22.

Figure 3:
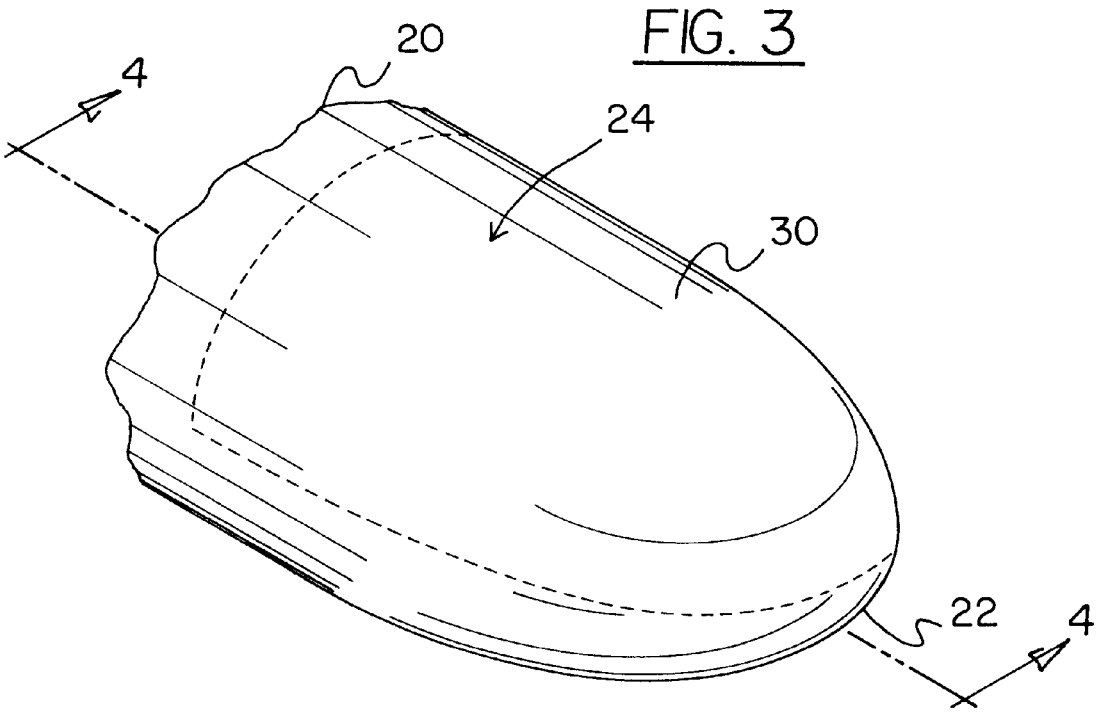
FIG. 3 is a schematic partial perspective view of a tip portion of a digit portion of the present invention.
Figure 4:
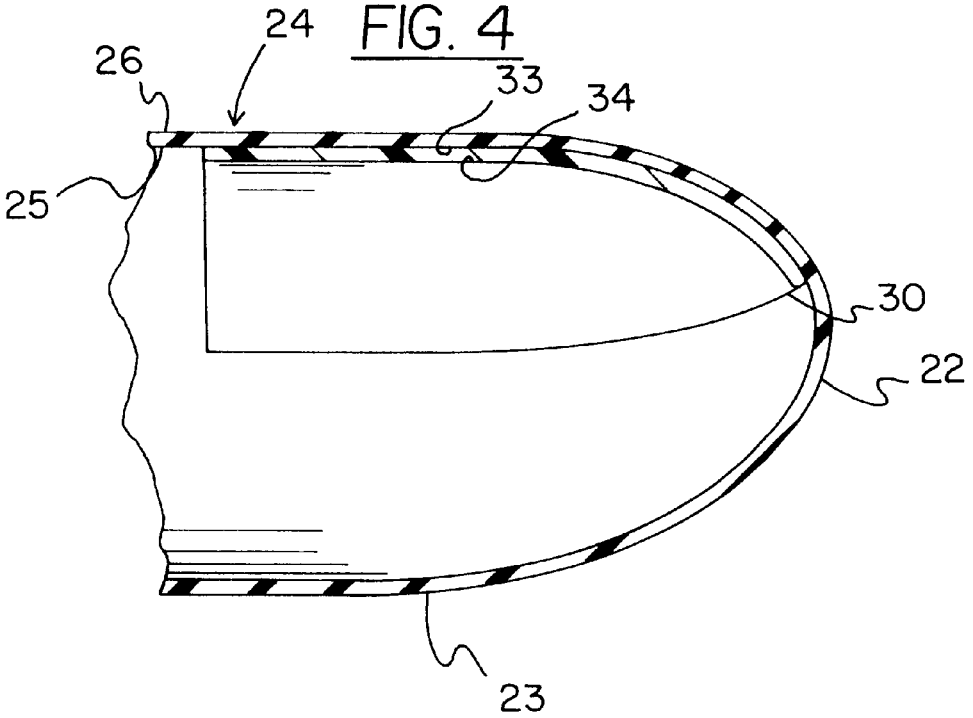
FIG. 4 is a schematic cross-sectional view taken from line 4—4 on FIG. 3.
Figure 5:
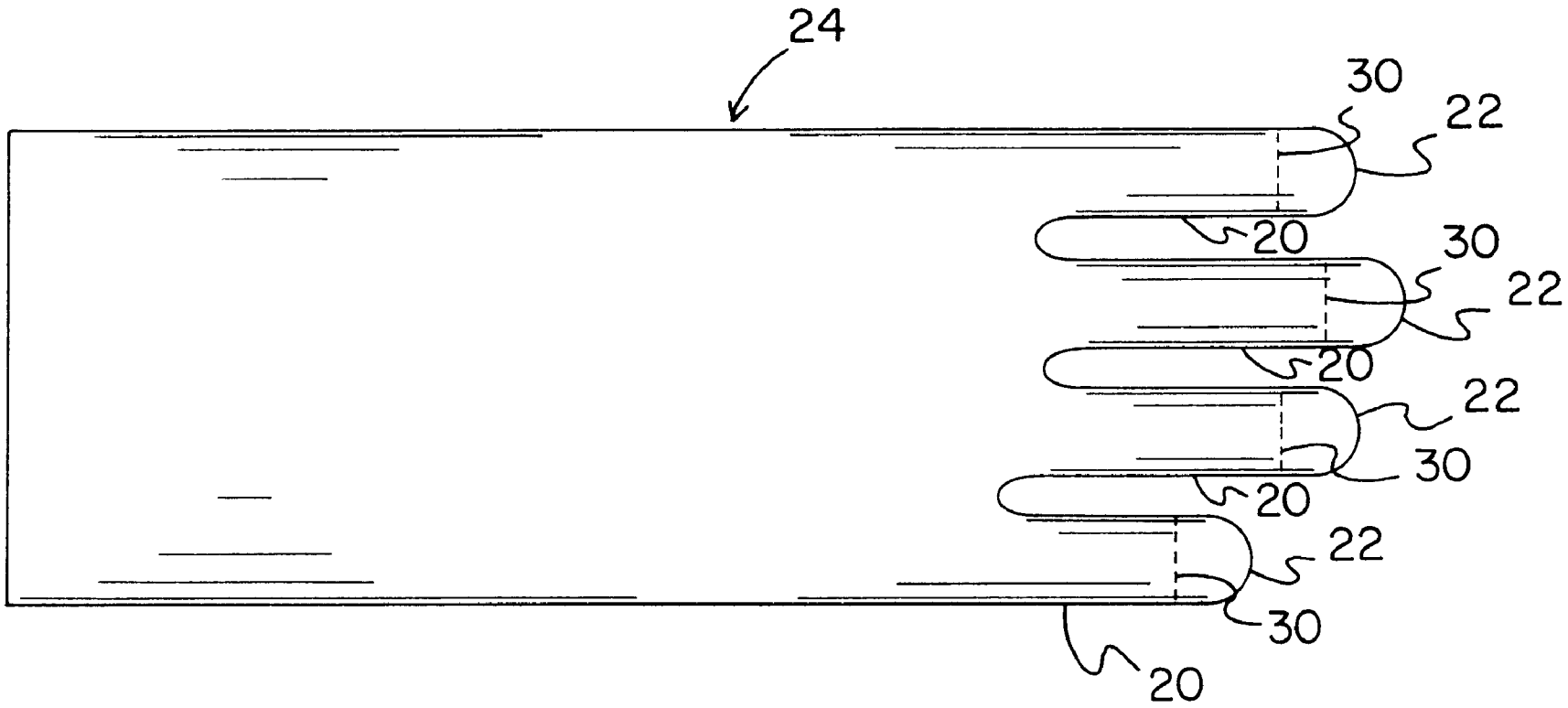
FIG. 5 is a schematic back side view of the present invention.

With particular reference to FIGS. 3, and 4, each of the digit portions 20 has a front 23, a back 24, and inner and outer surfaces 25,26. The thickness of each digit portion is defined as the distance between its inner and outer surfaces 25,26.

The back 24 of each of the digit portions 20 has a fingernail region 30 for protecting a fingernail from breaking and chipping. The fingernail region 30 is located towards the tip of its digit portion 20 and extends from the tip 22 towards the root 21 of the digit portion 20. The thickness of the fingernail region 30 of each digit portion 20 is greater than the thickness of the rest of the digit portion 20. Ideally, the greater thickness of the fingernail region 30 of each of the digit portions 20 is about twice the thickness of the rest of the digit portion 20.

Because of this difference in thickness, it is critical that the fingernail region not extend into the front 23 of the digit portions 20 so that the fingernail regions 30 do not inhibit the sensitivity, especially as to touch, of the finger pad portion of a finger inserted into the digit portion 20. Preferably, the fingernail regions 30 of each of the digit portions 20 is extended from the tip 22 towards the root 21 less than half the length of the digit portion 20. Ideally, the fingernail regions 30 are each extended from the tip 22 their digit portion 20 towards the root 21 of the digit portion 20 less than one third the length of the digit portion 20. This permits easy bending of the joints of a finger inserted into a digit portion 20.

While the fingernail regions 30 be formed integrally with the digit portions 20, preferably each of the fingernail regions 30 includes a second layer 32 having inner and outer surfaces 33,34 with a second layer thickness defined between the inner and outer surfaces 33,34. The inner surface 33 of the second layer 32 is coupled to the inner surface 25 of the fingernail region 30 of the digit portion 20 so that the greater thickness of fingernail region 30 of each digit portion 20 is defined between the outer surface 26 of the fingernail region 30 of the digit portion 20 and the outer surface 34 of the second layer 32. Ideally, at least half of the greater thickness of each fingernail region 30 is the second layer thickness so that the fingernail region 30 has a total thickness twice the thickness of the rest of its digit portion. The second layer 32 is preferably flexible and ideally comprises a flexible vinyl.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A glove, comprising:

a palm portion;

a plurality of digit portions being extended from said palm portion;

each of said digit portions having a root and terminating in a tip;

each of said digit portions having a front, a back, and inner and outer surfaces, and a thickness, said front, back and inner and outer surfaces each comprising a first layer of a single thickness;

wherein said thickness of each of said digit portions is defined between said inner and outer surfaces of said digit portion;

said back of each of said digit portions having a fingernail region, said fingernail region being extended from said tip of said digit portion towards said root of said digit portion;

the thickness of said fingernail region of each of said digit portions being greater than the thickness of the rest of said digit portion; and wherein each of said fingernail regions includes a second layer coupled to said inner surface of said fingernail region of said digit portion to produce approximately a double thickness at said fingernail regions, said second layer of said fingernail regions covering said back of said digit portion and said second layer having side portions extending from said back to a location at least halfway between said front and said back of said digit portion for providing enhanced protection to both a top and lateral sides of a fingertip of a wearer.

2. The glove of claim 1, wherein each of said digit portions has a length extending between said root and said tip of said digit portion, wherein said fingernail regions of each of said digit portions is extended from said tip of said digit portion less than half said length of said digit portion.

3. The glove of claim 1, wherein each of said digit portions has a length extending between said root and said tip of said digit portion, wherein said fingernail regions of each of said digit portions is extended from said tip of said digit portion less than one third said length of said digit portion.

4. The glove of claim 1, wherein the greater thickness of said fingernail region of each of said digit portions is about twice the thickness of the rest of said digit portion.

5. The glove of claim 1, wherein the greater thickness of said fingernail region of each of said digit portions is defined between said outer surface of said fingernail region of said digit portion and said outer surface of said second layer of said fingernail region.

6. The glove of claim 5, wherein at least half of the greater thickness of each of said fingernail regions is said second layer thickness of said second layer of said fingernail region.

7. The glove of claim 1, wherein said second layer comprises a flexible vinyl.

8. A glove, comprising:

a palm portion;

a plurality of digit portions being extended from said palm portion;

each of said digit portions having a root and terminating in a tip, each of said digit portions having a length extending between said root and said tip of said digit portion;

each of said digit portions having a front, a back, and inner and outer surfaces, and a thickness, said front, back and inner and outer surfaces each comprising a first layer of a single thickness;

wherein said thickness of each of said digit portions is defined between said inner and outer surfaces of said digit portion;

said back of each of said digit portions having a fingernail region, said fingernail region being extended from said tip of said digit portion towards said root of said digit portion;

wherein said fingernail regions of each of said digit portions is extended from said tip of said digit portion less than one third said length of said digit portion;

the thickness of said fingernail region of each of said digit portions being greater than the thickness of the rest of said digit portion;

wherein the greater thickness of said fingernail region of each of said digit portions is about twice the thickness of the rest of said digit portion;

wherein each of said fingernail regions includes a second layer, coupled to said inner surface of said fingernail region of said digit portion to produce approximately a double thickness at said fingernail regions, said second layer of said fingernail regions covering said back of said digit portion and said second layer having side portions extending from said back to a location at least halfway between said front and said back of said digit portion for providing enhanced protection to both a top and lateral sides of a fingertip of a wearer;

wherein the greater thickness of said fingernail region of each of said digit portions is defined between said outer surface of said fingernail region of said digit portion and said outer surface of said second layer of said fingernail region;

said wherein at least half of the greater thickness of each of said fingernail regions is said second layer thickness of said second layer of said fingernail region; and wherein said second layer comprises a flexible vinyl.

* * * * *